US009949503B2

(12) United States Patent
Lin et al.

(10) Patent No.: US 9,949,503 B2
(45) Date of Patent: Apr. 24, 2018

(54) SEMI-AUTOMATIC AND FULLY-AUTOMATIC CIGARETTE-MAKING MACHINES FOR MAKING CIGARETTES OF VARYING LENGTHS

(71) Applicant: REPUBLIC TOBACCO L.P., Glenview, IL (US)

(72) Inventors: Mei Lin, Northbrook, IL (US); Jeongqiang Lin, Jiangmen (CN)

(73) Assignee: REPUBLIC TOBACCO L.P., Glenview, IL (US)

( * ) Notice: Subject to any disclaimer, the term of this patent is extended or adjusted under 35 U.S.C. 154(b) by 530 days.

(21) Appl. No.: 14/602,064

(22) Filed: Jan. 21, 2015

(65) Prior Publication Data

US 2016/0205994 A1 Jul. 21, 2016

(51) Int. Cl.

| | |
|---|---|
| ***A24C 5/06*** | (2006.01) |
| ***A24C 5/42*** | (2006.01) |
| ***A24C 5/02*** | (2006.01) |
| ***A24C 5/40*** | (2006.01) |

(52) U.S. Cl.

CPC ..... *A24C 5/06* (2013.01); *A24C 5/02* (2013.01); *A24C 5/40* (2013.01); *A24C 5/42* (2013.01); *A24C 5/425* (2013.01)

(58) Field of Classification Search

CPC ..... A24C 5/06; A24C 5/425; A24C 5/42

See application file for complete search history.

(56) References Cited

U.S. PATENT DOCUMENTS

| | | | | |
|---|---|---|---|---|
| 2,731,971 | A | 1/1956 | Kastner | |
| 3,127,900 | A * | 4/1964 | Kastner | A24C 5/425 131/70 |
| 3,746,011 | A | 7/1973 | Kappeler et al. | |
| 4,249,546 | A * | 2/1981 | Heil | A24C 5/425 131/70 |
| 5,398,701 | A | 3/1995 | Neumann et al. | |
| 6,557,560 | B2 | 5/2003 | Kastner | |
| 2004/0099276 | A1 | 5/2004 | Parcevaux | |

(Continued)

FOREIGN PATENT DOCUMENTS

| | | |
|---|---|---|
| CN | 102813280 A | 12/2012 |
| CN | 202618256 U | 12/2012 |

(Continued)

OTHER PUBLICATIONS

Google machine Engllish translation of CN203776151U (Oct. 12, 2017).*

(Continued)

*Primary Examiner* — Anthony Calandra

(74) *Attorney, Agent, or Firm* — Michael Best & Friedrich LLP

(57) ABSTRACT

A cigarette tobacco compacting mechanism for making cigarettes in two or more different lengths having a compacting chamber for receiving loose tobacco, a compacting member mounted for reciprocal motion in the compacting chamber to compact the loose tobacco, and one or more retractable sizing members each having a tab mounted for movement across the compacting chamber for shortening the effective width of the compacting chamber to enable the compacting chamber to accommodate hollow cigarette tubes of varying lengths.

14 Claims, 10 Drawing Sheets

(56) References Cited

U.S. PATENT DOCUMENTS

| | | | | |
|---|---|---|---|---|
| 2004/0200485 | A1* | 10/2004 | Garbarino | A24C 5/425 131/70 |
| 2007/0235045 | A1 | 10/2007 | Lin | |
| 2013/0276800 | A1* | 10/2013 | Lin | A24C 5/42 131/289 |
| 2014/0034069 | A1* | 2/2014 | Chen | A24C 5/06 131/70 |

FOREIGN PATENT DOCUMENTS

| | | | |
|---|---|---|---|
| CN | 103445292 | A | 12/2013 |
| CN | 103798956 | A | 5/2014 |
| CN | 203776151 | U | 8/2014 |
| CN | 204599314 | U | 9/2015 |
| EP | 1844668 | A2 | 10/2007 |

OTHER PUBLICATIONS

First Office Action from the State Intellectual Property Office of the People's Republic of China for Application No. 201510189322.X dated Apr. 26, 2017 (17 pages).

Search Report from the Turkish Patent Institute for Application No. 2015/04787 dated Apr. 27, 2017 (3 pages).

United Kingdom Intellectual Property Office Search Report issued in corresponding application GB 1502857.4, dated Aug. 17, 2015, 4 pages.

Hungarian Search Report from the Hungarian Intellectual Property Office for Application No. P1500067 dated Aug. 29, 2016 (1page).

Spanish Search Report from the Spanish Patent Office for Application No. 201530416 dated Oct. 26, 2016 (6 pages).

* cited by examiner

SEMI-AUTOMATIC AND FULLY-AUTOMATIC CIGARETTE-MAKING MACHINES FOR MAKING CIGARETTES OF VARYING LENGTHS

FIELD OF THE INVENTION

This invention pertains generally to cigarette-making machines and, more particularly, to semi-automatic and fully automatic machines for making cigarettes in a multiple lengths.

BACKGROUND

Various types of manual, semi-automatic and automatic cigarette-making machines are known in which loose tobacco is compacted into a rod-like shape and transported into a hollow cigarette tube to prepare a cigarette. In many of these cigarette-making machines loose tobacco is first placed into a compacting chamber in which a reciprocating compacting member engages and compresses the loose tobacco into the rod-like shape on an injection spoon at the bottom of the compacting chamber. The compressed tobacco rod-like shape is then transported by the injection spoon which moves across the compacting chamber to carry the rod-like tobacco shape into a hollow cigarette tube positioned outside the cigarette-making machine and adjacent the chamber.

In fully manual cigarette-making machines both the compressing of the loose tobacco into a rod-like shape and the transporting of the rod-like tobacco shape into a hollow cigarette tube are performed by manually operating a crank on the machine. In typical semi-automatic cigarette-making machines, the loose tobacco in the compacting chamber is compressed manually by operating a crank to compress the loose tobacco between the leading edge of a compacting member and an injection spoon located in the compacting chamber to form the rod-like tobacco shape. Upon completion of the compressing step, typically a motor is automatically triggered to cause the injection spoon to move across the compacting chamber transporting the rod-like tobacco shape into the hollow cigarette tube. Finally, in fully automatic cigarette-making machines, both the compressing of the loose tobacco into a rod-like shape and the transporting of the rod-like tobacco shape into a hollow cigarette tube are performed by triggering one or more motors which first drive a compressing member to form a rod-like tobacco shape on an injection spoon and then drive the injection spoon (or other transporting component) to carry the rod-like tobacco shape into a hollow cigarette tube.

While it is well-recognized that commercially manufactured cigarettes come in various different lengths, semi-automatic and fully-automatic cigarette-making machines currently can only make cigarettes of a single length which generally corresponds to the length of the compacting chamber. Therefore, in order to make cigarettes of multiple lengths, different semi-automatic and fully-automatic machines specifically designed to make each desired cigarette lengths must be used. This is inconvenient, wasteful and uneconomic.

It is therefore an object of present embodiments to provide semi-automatic and fully-automatic cigarette-making machines that can make cigarettes of different lengths.

BRIEF SUMMARY

Embodiments of the invention include semi-automatic and fully-automatic cigarette-making machines having a compacting chamber for receiving loose tobacco and a compacting member of a width corresponding to that of the chamber which moves from the top to the bottom of the chamber to compact the loose tobacco into a compressed tobacco rod-like shape and withdraws. In semi-automatic cigarette-making machines, the compacting member is operated manually to first compress the loose tobacco and then it is manually withdrawn. In fully-automatic cigarette-making machines, the movement of the compacting member to compress the loose tobacco is motor driven, as is the withdrawal of the compacting member. In both fully-automatic and semi-automatic machines, once the compacting member is withdrawn, the compressed tobacco rod-like shape is automatically transported through a nipple extending from the side of the machine in communication with a passage in the injection end of the compacting chamber. The opposite end of the compacting chamber is closed.

In both the semi-automatic and the fully-automatic embodiments, the nominal or maximum length of the tobacco-receiving, tobacco-receiving opening of the compacting chamber is defined by a rectangle extending between the top and the bottom of the chamber and between the ejection and opposite closed end of the chamber. The distance between the injection and the opposite closed end corresponds to the maximum cigarette tube length that can be filled by the machine.

In order to accommodate both the first longer cigarette tube length and a second shorter cigarette tube length, a tab is introduced into the chamber opposite the chamber closed and extending between the top and the bottom of the chamber. This tab reduces the length of the chamber available for receiving loose tobacco so that a shorter cigarette tube of this reduced length may be used with the machine. Two common cigarette tube lengths are 84 mm and 100 mm. In order to accommodate these cigarette tube lengths, the nominal length of the compacting chamber will be about 100 mm and the reduced chamber length will be about 84 mm. As explained below, embodiments can accommodate more than two cigarette tube lengths.

Accommodating differing cigarette tube lengths by reducing the length of the compacting chamber presents at least two challenges. First, the compacting member will have a width corresponding to the nominal width of the compacting chamber. If a tab is introduced to reduce the length of the chamber, this tab will interfere with the compacting movement of the compacting member. In embodiments this problem is solved by forming a slot extending from the compacting edge of the compacting member and positioned along the compacting member to receive the tab. Thus, when the compacting member is operated, it will be able to move from the top to the bottom of the compacting chamber to compact only the tobacco in the reduced chamber length while receiving the tab in the compacting member slot. When more than two cigarette tube lengths are to be accommodated, additional slots will be provided extending from the compacting edge of the compacting member to receive additional tabs.

The next significant challenge relates to manipulating the tab within the confined and component-filled interior of the cigarette-making machine. Tab controls are accessible in embodiments from a convenient location on the outside of the machine and preferably employ a flat linkage which consumes little space and ensures reliable operation.

BRIEF DESCRIPTION OF THE DRAWINGS

In order to aid in understanding embodiments of the invention, it will now be described in connection with exemplary embodiments thereof with reference to the accompanying drawings in which like numerical designations will be given to like features.

DETAILED DESCRIPTION OF EXEMPLARY EMBODIMENTS

The embodiments described below are not intended to be exhaustive or limited to the precise structures and operation disclosed. Rather, the described embodiments have been chosen to explain principles of the invention and their application, and the operation and use of embodiments of the invention in order to best enable others skilled in the art to follow its teachings.

Figure 1:
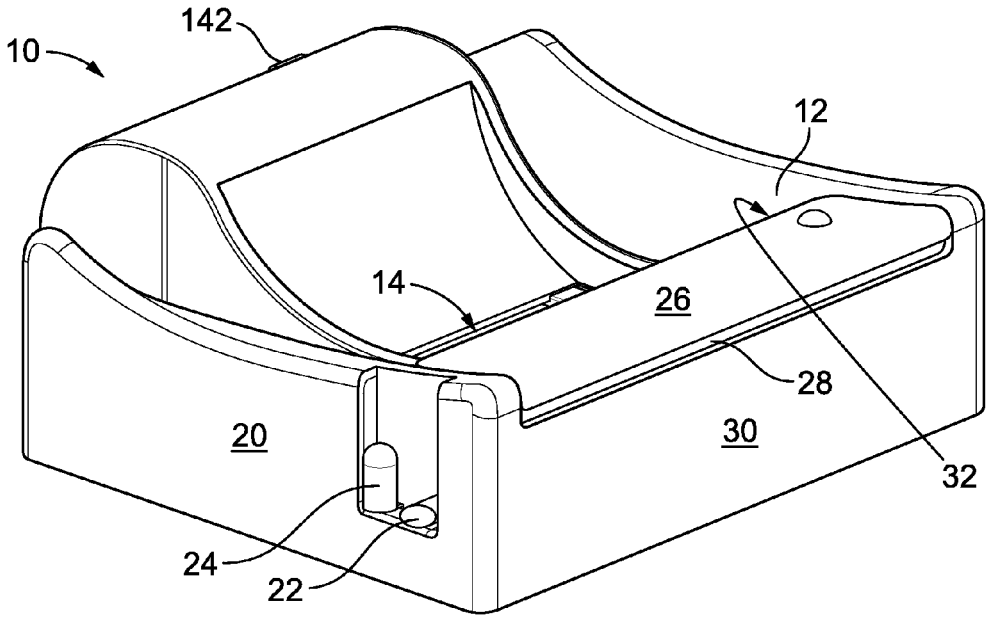
FIGS. 1 and 2 are perspective views of an embodiment, differing in that in FIG. 2 the protective system door has been removed to better display the compacting chamber and its environs.
Figure 2:
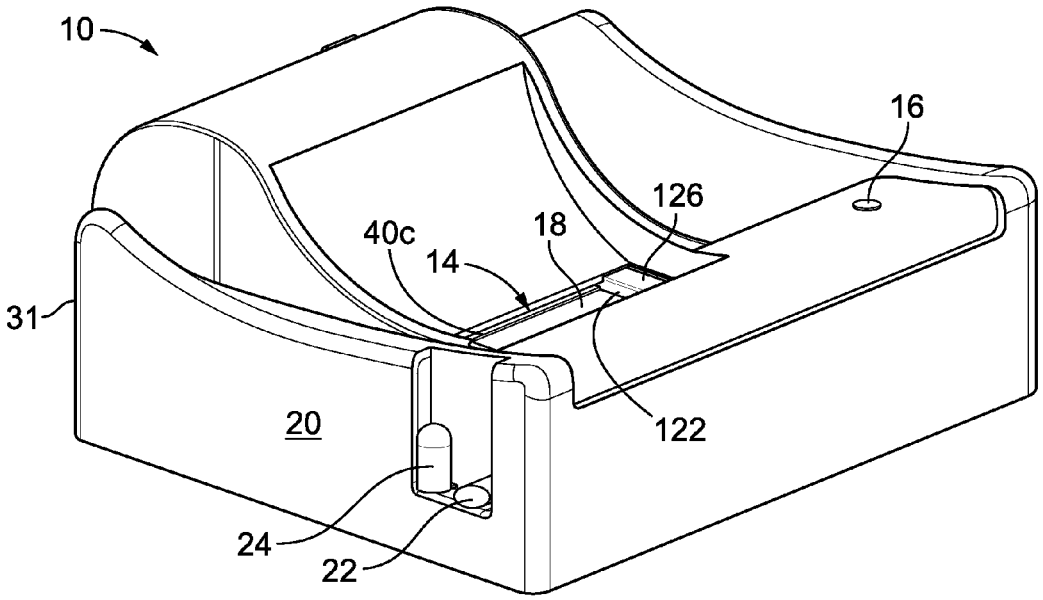

Referring now to the figures, FIGS. 1 and 2 are perspective views of a fully-automatic cigarette-making machine 10, including a top surface 12, a compacting chamber access opening 14 and a compacting chamber 18 that lies below the access opening. Sidewall 20 of the machine housing, which lies adjacent one end of the compacting chamber, has a hollow nipple 22 in communication with the compacting chamber. Hollow cigarette tubes (not shown) may be slid onto the nipple and held in place while being filled by a locking arm 24.

Cigarette-making machine 10 is operated by placing loose tobacco (not shown) through compacting chamber access opening 14 and into compacting chamber 18. The hollow cigarette tube may be placed onto the nipple either before or after this step.

Machine 10 may optionally also include a protective system door 26 to protect a user's fingers from injury at the compacting chamber during the tobacco compressing process. Door 26 is pivotally attached along its bottom edge 28 to the front 30 of the machine housing by way of hinge members (not shown). Door 26 may include a downwardly directed pin on its bottom surface 32 and machine 10 may include a pushbutton switch 16 (or other pressure operated switch) located on top surface 12 positioned to be engaged by the pin when the door is closed.

When it is desired to use a machine provided with the optional protective system, door 26 is first pivoted away from compacting chamber access opening 14 so that the compacting chamber can be filled with tobacco, and then pivoted toward the compacting chamber access opening. As the door reaches its rest position blocking entry from above to the access opening (and therefore preventing the user's fingers from reaching into the compacting chamber), the pin on the bottom surface of the door presses down upon pushbutton switch 16 to begin the automatic operation of the cigarette-making machine. If the door is raised before completion of the tobacco injection cycle, automatic operation of the machine is paused until the door is again closed. In alternative embodiments, the pushbutton switch may protrude above top surface 12 so that a bottom surface portion of the door will press down upon and operate the protruding pushbutton switch.

The protective system may be utilized as either an interlock system to prevent any motor-driven automatic operation of a cigarette-making machine if door 24 is not closed (and therefore blocking accidental access to the chamber access opening) or it may act as both a protection system as described and as a trigger system to initiate automatic motor-driven operation when the door is closed.

Figure 3A:
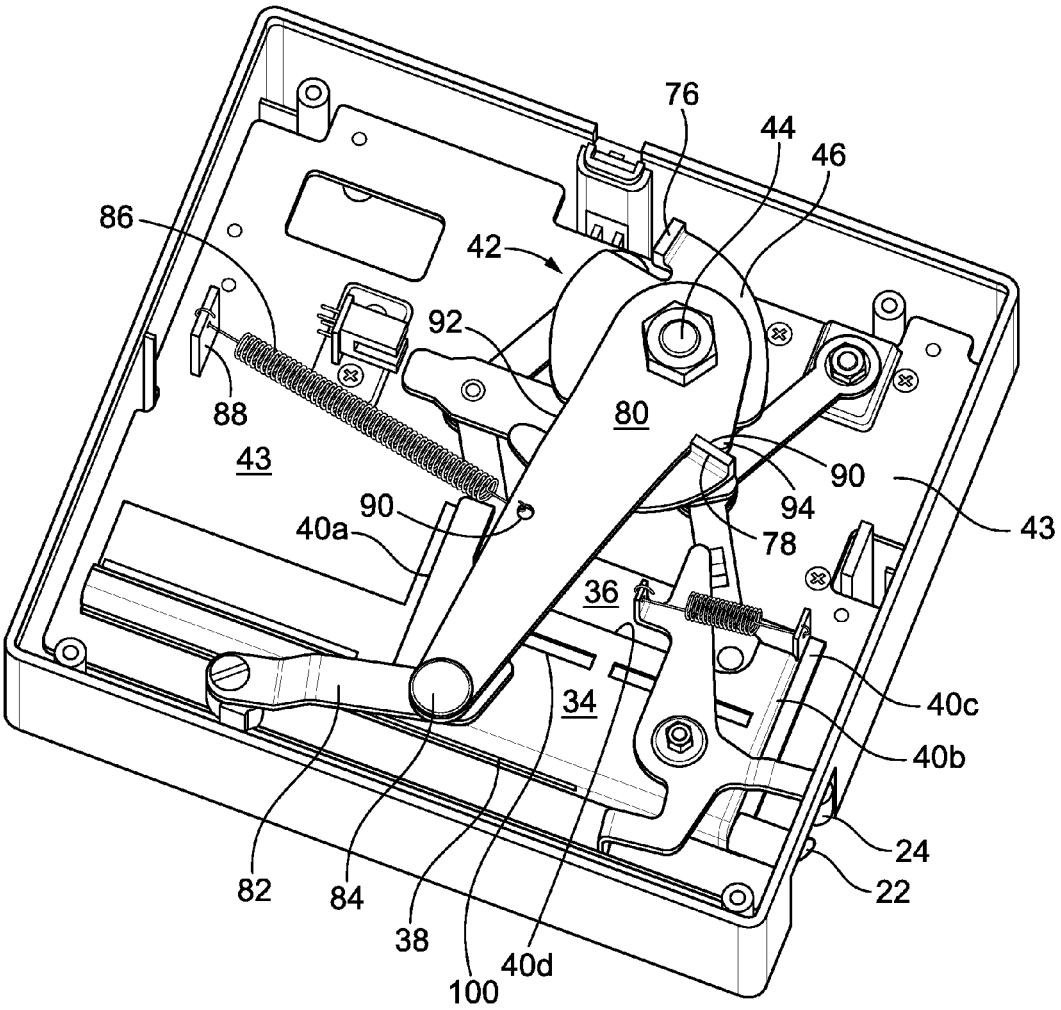
FIG. 3A is a bottom perspective view in which the bottom machine housing cover has been removed to reveal operating components on a supporting plate.

FIG. 3A is a bottom perspective view of the cigarette-making machine of FIGS. 1-2 in which the bottom cover of the machine housing has been removed in order to reveal certain working parts of the device. From this view, compacting chamber 18 (FIG. 2) is a generally rectangular pocket lying above fixed plate 34 with side walls 40*a* and 40*b*, a top plate 40*c* and a bottom plate 34. Compacting chamber access opening 14 is formed in top plate 40*c*. A compacting member 36, preferably with an inwardly curved leading edge to help form tobacco into a round rod-like shape, is mounted for movement across the compacting chamber beginning at its initial rest position (illustrated in FIG. 3B) in which the compacting member is disposed generally outside of the compacting chamber. Side edges 40*a* and 40*b* wall off the compacting chamber to laterally confine the tobacco in the chamber and to help guide the movement of the compacting member within the chamber. Top edge 40*d* of the compacting chamber is open to permit compacting member 36 to rest outside of the chamber when it is in its initial rest position.

While the compacting member is disposed in this initial rest position, loose tobacco is placed into the compacting chamber and rests upon an injection spoon 38 in its initial position at the bottom of the chamber. Once the tobacco is in place, the compacting member moves across the compacting chamber, coming to rest at its fully extended position (shown in broken lines in FIG. 3B) with the loose tobacco compacted into a rod-like shape resting upon injection spoon 38 in its final extended position (shown in broken lines).

Figure 5A:
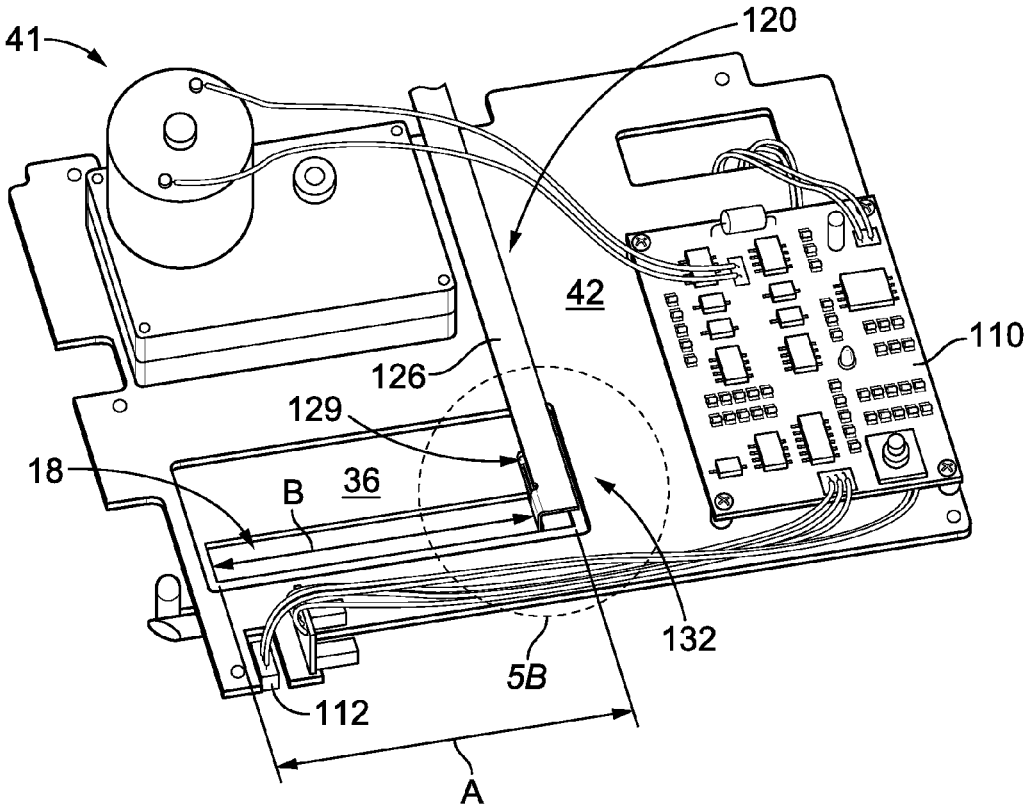
FIG. 5A is a perspective view of the componentry on the top of the plate seen in FIGS. 3A, 3B and 4, including the retractable sizing member.

The movement of the compacting member to its final extended position to compress the loose tobacco as well as the return of the compacting member to its initial position is achieved in the illustrated embodiment by a compacting drive mechanism 42 which may be driven through the rotation of a driveshaft 44 of electric motor 41 (mounted below plate 43), as can be seen in FIG. 5A. Driveshaft 44 of motor 43 protrudes above plate 43 and is shown in FIGS. 3A and 3B.

In a fully automatic machine, illustrated driveshaft 44 may be the shaft of a motor as already noted. In a semi-automatic machine or in a fully manual machine, the driveshaft may be manually operated by rotating from above as in, for example, U.S. Pat. No. 2,731,971. The teaching and disclosures of this patent are incorporated herein by reference. Whether manually operated or motor driven, movement of the compacting member across the compacting chamber as illustrated, for example, in FIG. 3B, is controlled by the compacting drive mechanism 42 associated with either a motor driven driveshaft 44 (FIG. 1) or a manually operated driveshaft.

Figure 3B:
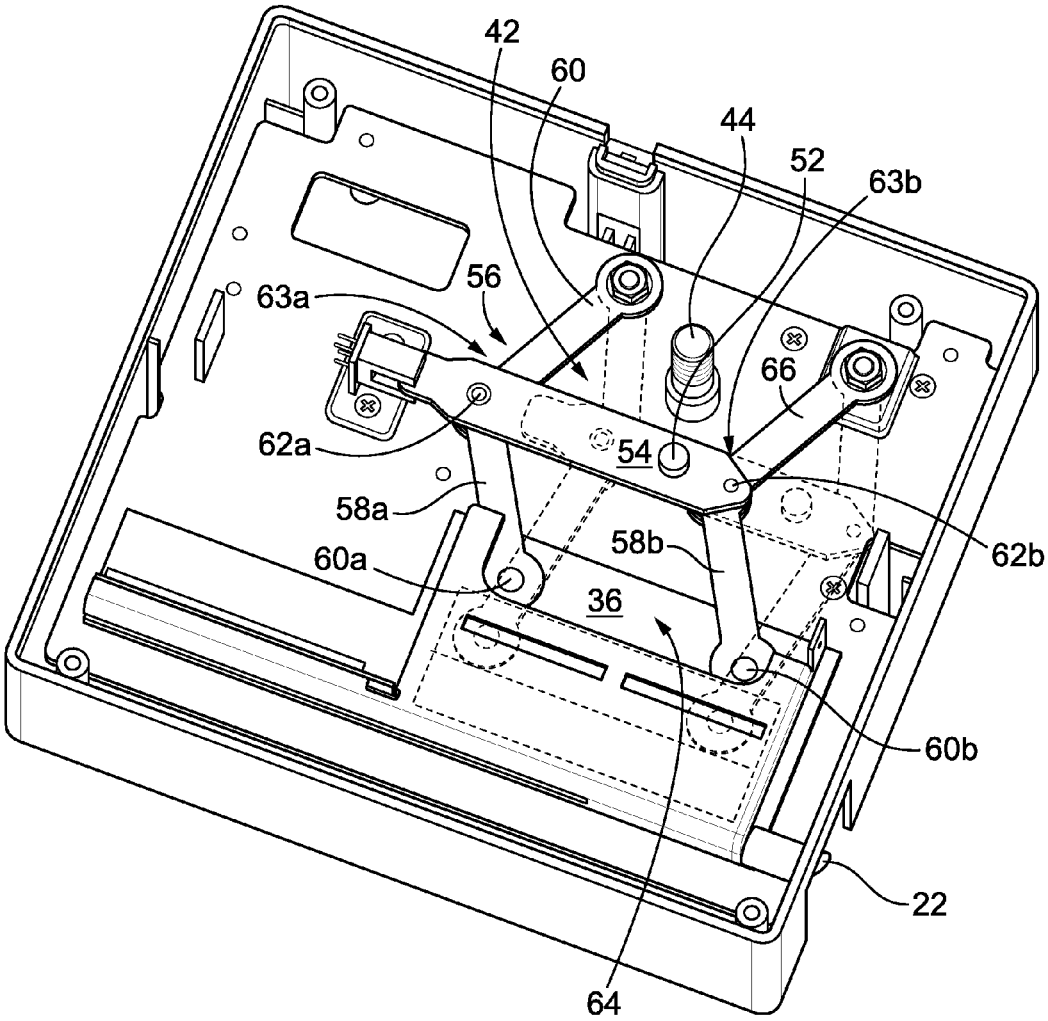
FIG. 3B corresponds to FIG. 3A except that the cam and injection spoon control arm have been removed to better illustrate the compacting drive mechanism.
Figure 4:
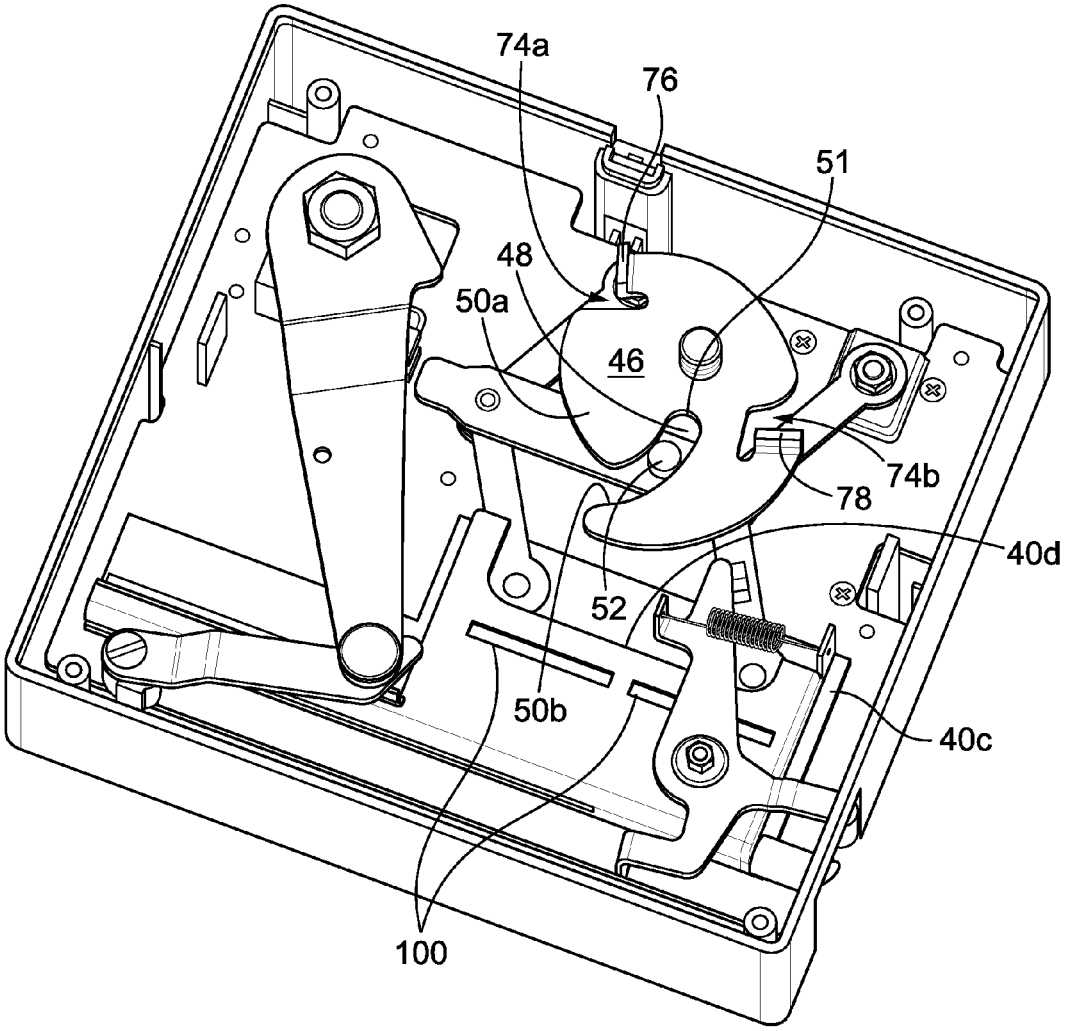
FIG. 4 corresponds to FIGS. 3A and 3B except that the injection spoon control arm is removed and the cam is in place to better illustrate the operation of the cam in conjunction with the compacting drive mechanism.

Compacting drive mechanism 42 includes a cam 46 affixed to driveshaft 44 as can best be seen in FIG. 4. Cam 46 has a curved recess 48 with opposed edges 50*a* and 50*b* positioned to engage and guide a stud 52 which projects upwardly from transverse link 54 of a dual toggle joint assembly 5 (FIG. 3B). Cam 46 also includes cutout areas 74*a* and 74*b* with upwardly directed stops 76 and 78 which come into play during the injection process of the machine and will be discussed below. The dual toggle joint assembly is attached, as described below, to compacting member 36, to achieve generally parallel motion of the compacting member within compacting chamber 18.

As best can be seen in FIG. 3B, dual toggle joint assembly 56 includes lower links 58*a* and 58*b* which are rotatably pinned at first link ends 60*a* and 60*b* near lateral sides of the top portion 64 of the compacting member and at the opposite second link ends to knee pivots 62*a* and 62*b* along transverse link 54.

The dual toggle joint assembly also includes upper links 66*a* and 66*b* which are respectively connected at their first ends 63*a* and 63*b* to knee pivots 62*a* and 62*b* and, at their second opposite ends rotatably pinned to plate 43 by bolts 65*a* and 65*b*.

Guide stud 52 on transverse link 54 extends into curved recess 48 of cam 46, as shown in FIG. 4. Thus, beginning at the initial position of compacting member 28, the dual toggle assembly is oriented as shown in solid lines in FIG. 3B. After loose tobacco is placed in compacting chamber 18, driveshaft 44 is rotated in a counterclockwise direction, either by operation of a motor as in the illustrated embodiment, or manually. This causes cam 46 to rotate in a counterclockwise rotation so that guide stud 52 is engaged by edge 50*a* of the recess which causes the stud to move downwardly in the figures (or across the compacting chamber). Since the stud is mounted on transverse link 54, and the link is mounted for parallel motion in dual toggle joint assembly 56, this causes compacting member 36 to likewise move downwardly in the figure (or across the compacting chamber) to the fully extended position of the compacting member shown in broken lines in FIG. 3B. Slot 48 is configured so that the guide stud reaches the rounded end 51 of the slot when the compacting member is in its fully extended position.

Returning to FIG. 3A, an injection spoon control arm 80 is shown rotatably mounted for freely pivoting about driveshaft 44 and is connected at its outer edge to the injection spoon by a link 82 that is pivotally secured to arm 80 at pin 84. This arm is maintained in the rest position illustrated in FIG. 3A by spring 86 affixed to plate 43 at post 88 and to the control arm at hole 90. Accordingly, as cam 46 continues to rotate in a counterclockwise direction stud 52 rotates within the slot rounded end 51 as transverse link 54 remains in place with the compacting member in its fully extended position, and stop 76 engages edge 92 of control arm 80. Continued counterclockwise rotation of the cam and therefore stop 76 pushes the arm counterclockwise causing the injection spoon to be drawn laterally across the compacting chamber by link 82 to carry the compacted rod-like tobacco shape laterally through nipple 22 and into a hollow cigarette tube mounted on the nipple. This step may be motor-driven as in the illustrated embodiment, or it may be performed manually.

Following this placement of the compacted rod-like tobacco shape in the hollow tube, the process is reversed so that the injection spoon is withdrawn from the now filled cigarette tube and returned to its initial position within the compacting chamber and then the compacting member is retracted from the compacting chamber so that it returns to its initial position depicted in FIG. 3B. This is accomplished by reversing the direction of rotation of driveshaft 44 to a clockwise direction so that cam 46 begins its clockwise rotation, guide stud 52 is moved upwardly in the figures to return transverse link 54 and hence the compacting member to its initial position. After the compacting member is in its initial position, the further clockwise rotation of the cam brings stop 78 into contact with hook projection 94 of injection arm 80 so that the continued rotation of the cam moves the injection arm back to its initial position, thereby withdrawing the injection spoon from the filled cigarette which may now be removed from nipple 22. As noted earlier, in semi-automatic and automatic machines the action of the compacting drive mechanism and/or the injection drive mechanism may be motor-driven and in a fully manual machine both steps may be performed manually by replacing the automatic operation of motor 41 with manual activation and control.

The illustrated embodiment also includes an optional self-cleaning generally horizontal slot 100 running across compaction chamber plate 34. Preferably, slot 100 will be generally perpendicular to the face of the plate and of a length equal to or greater than the width of the compacting member, although the slot may be angled with respect to the plate face and it may have intervening strengthening portions as shown. The height of the slot may vary but it should be sufficiently narrow to ensure that little or no loose tobacco can escape from the slot as the compacting member moves in the compacting chamber. Also, the slot may be angled from the horizontal across the plate.

The function and operation of self-cleaning slot 100 is to remove fines and other materials that accumulate on the surface of the compacting member adjacent the slot. Thus, as the compacting member is retracted from the compacting chamber, its outer surface moves across self-cleaning slot 100 causing accumulated tobacco fines and gummy materials to be scraped-off against the edges of the slot so that these materials are ejected from the compacting chamber through the slot and fall to the bottom of the cigarette making machine where they will not cause any difficulties. The self-cleaning slot thus helps ensure long-term continued operation of the cigarette-making machine without undue friction due to build-up of fines and gummy materials.

Turning now to FIG. 5A, motor 41 is shown mounted to the back of plate 43. The motor is connected to a PC board 110 with appropriate circuitry to control the motor operation and to automatically reset the system to the start position in case of a jam, so that the jam can be cleared as appropriate. Power to the PC board, is supplied from an AC powered external jack 112 wired to the PC board includes an elongated generally flat and rigid linkage 126.

A retractable sizing member 120 is captured between the top surface of plate 43 and the underside of the machine housing top surface 12. The retractable sizing member has a tab 122 at its proximal end 124 that may be moved into or out of compacting chamber 18 as desired, to vary the length of the chamber to correspond to two differing cigarette/cigarette tube lengths. If it is desired to produce cigarettes in more than two lengths, multiple retractable sizing members may be used. The multiple retractable sizing members may be lined up side-by-side and structured/supported in the same fashion as retractable sizing member 120.

Figure 5B:
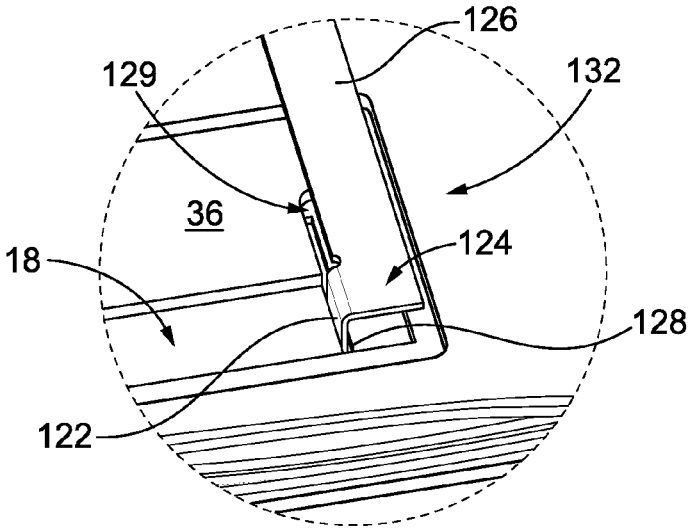
FIG. 5B is an enlarged view of the proximal end of the retractable sizing member taken at the broken line circle appearing in FIG. 5A.
Figure 6:
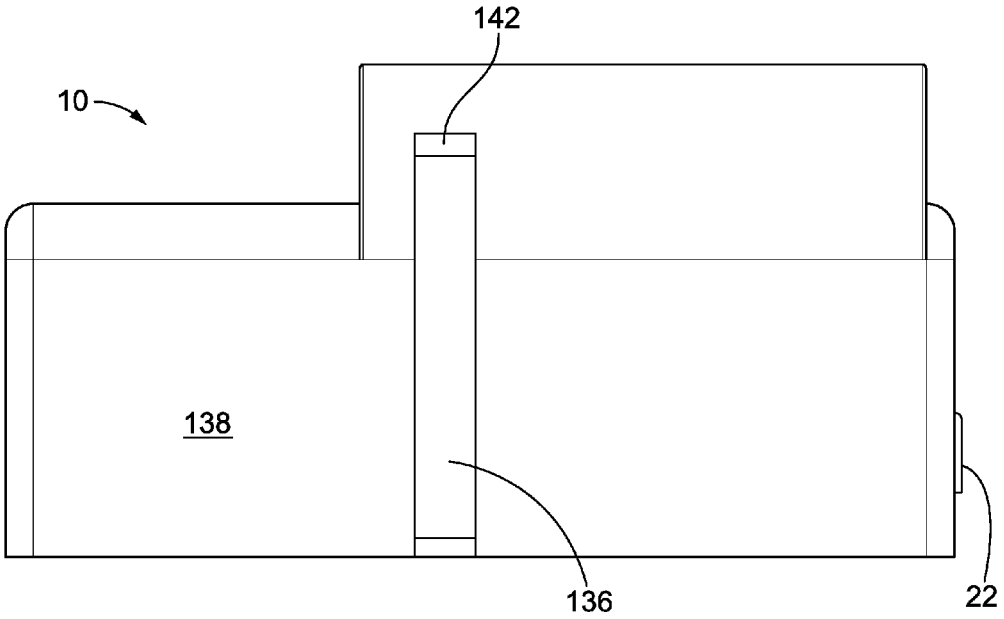
FIG. 6 is a back elevation view of the housing in the embodiment of FIGS. 1 and 2.

As can be seen in the enlarged partial view of FIG. 5B, tab 122 is generally perpendicular to a rigid flat elongated linkage 126 and extends upwardly from linkage 126 into the compacting chamber to shorten the length of the chamber when necessary to fill a cigarette of a corresponding shorter length. Tab 122 rides in slot 128 in top wall 40*c* of the compacting chamber. Additionally, compacting member 36 includes a clearance slot 129. When tab 122 is in place as shown in FIG. 5B slot 129 permits the compacting member to clear tab 122 as it moves across the compacting chamber.

Figure 7A:
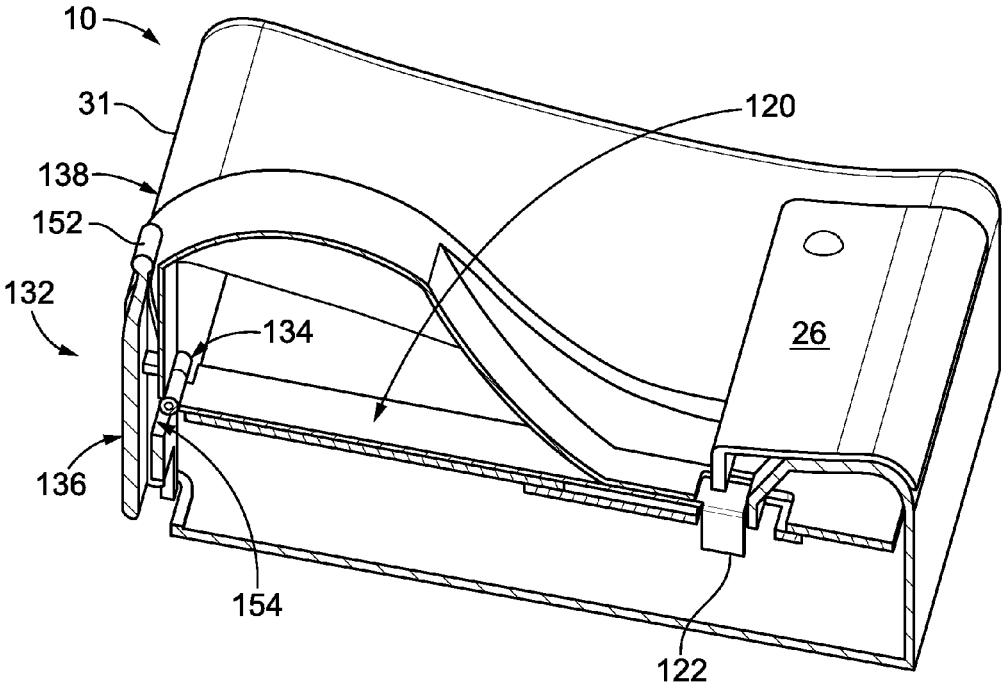
FIGS. 7A and 7B are cutaway perspective views of the embodiment of FIGS. 1 and 2 respectively showing the retractable sizing member tab in position in the compacting chamber and retracted from the compacting chamber.
Figure 7B:
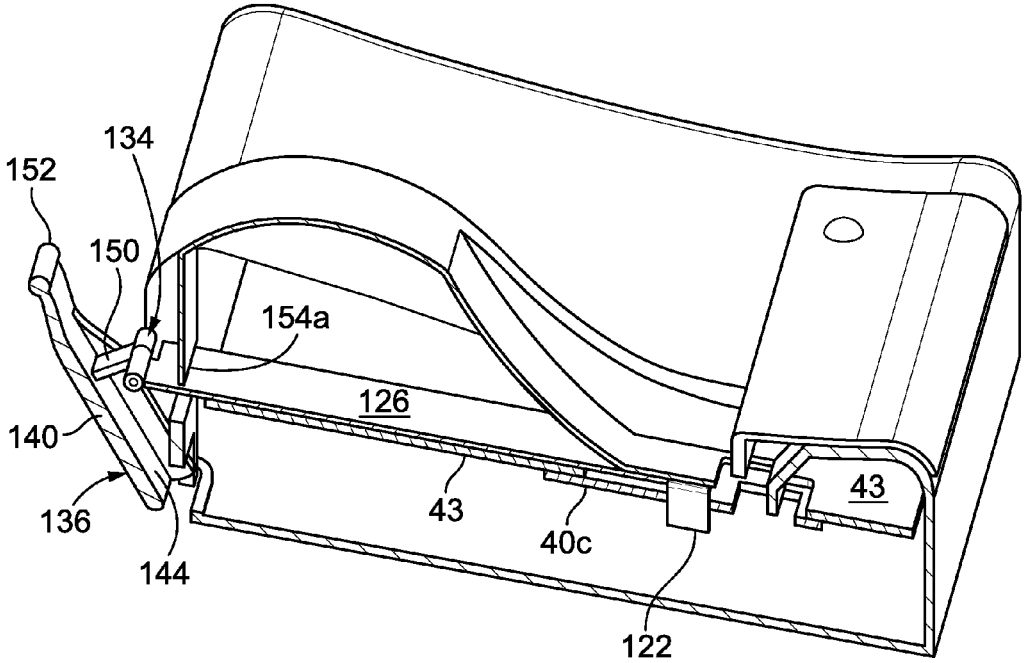
Figure 7C:
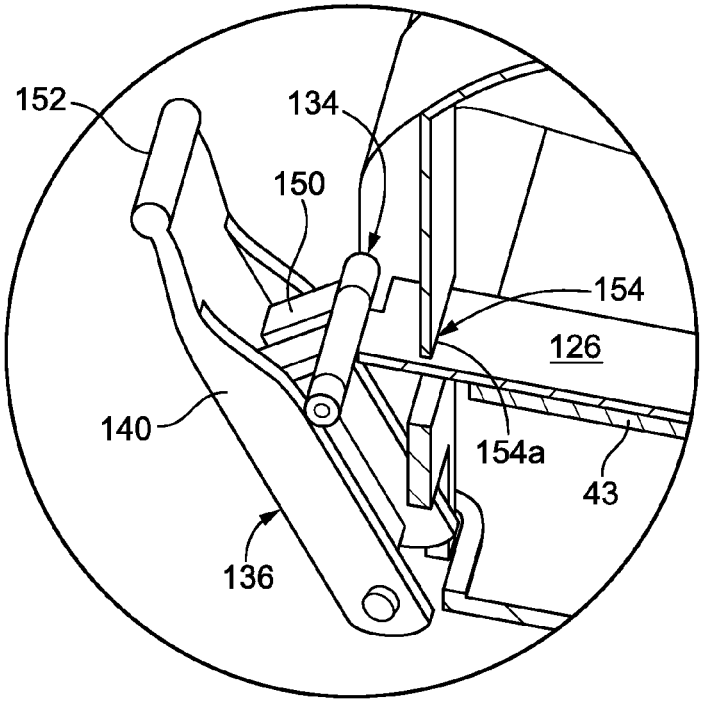
FIG. 7C is an enlarged partial view of the distal end of the sizing member.

Sizing member 120 can be seen in the sectioned views of FIGS. 7A and 7B, including the distal end 132 of the sizing member. Distal end 132 of member 120 extends through a slot 154 in back wall 31 of the machine housing. The distal end includes a hinge 134. An external control arm 136 is located near and accessible from surface 138 of the back of the machine housing. The external control arm includes an elongated portion 140 with stub arm 150 which extends generally perpendicularly from the back surface 144 of elongated portion 140. The distal end of the stub arm is rotatably attached to linkage 126 at hinge 134. Preferably, the top portion of external control arm 136 extends above the machine back surface and includes a knob 152.

Figure 7D:
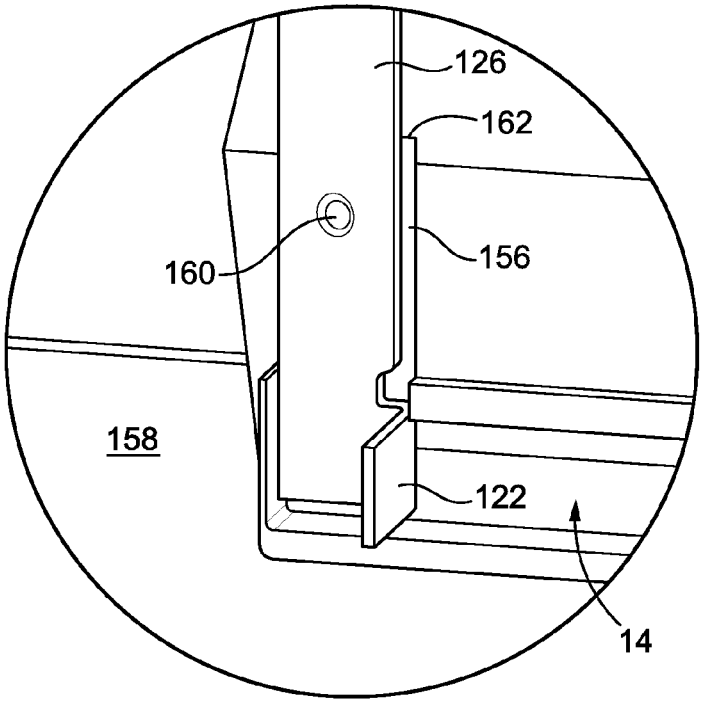
FIG. 7D is an enlarged partial view of the sizing member riding in a channel in the underside of the housing of FIGS. 1 and 2.

The sizing member linkage is confined laterally by way of cooperation between the side edges of slot 154 and a channel 156 cut into the back surface of the housing in a flat portion 158 of the housing above compacting chamber access opening 14 (FIG. 7D). Movement of the sizing member to position or remove tab 122 from the compacting chamber is maintained in a plane by confining elongated linkage 126 between plate 43, the surface of channel 156 and the top edge 154*a* of slot 154.

As can also be seen in FIG. 7D, elongated linkage 126 includes an upwardly protruding dimple 160 which rides along the surface of channel 156 in the underside 158 of the top of the machine housing. Since the elongated linkage is maintained in tension against the channel surface as it moves along its elongated direction, when the sizing member is moved toward the back of the machine housing and into the position illustrated in FIG. 7B dimple 160 will move across channel edge 162. As the dimple moves across the edge, it produces a "snap" signal as well as a tactile signal to the user indicating that the retractable sizing member has been moved into a predetermined rest position with tab 122 outside of the compacting chamber.

Thus, the illustrated embodiment of the invention can produce cigarettes of two different lengths. The longer length will be made by withdrawing the sizing tab from the compacting chamber as illustrated in FIG. 7B. In this embodiment, the effective width of the compacting chamber will be its full width which will be generally equal to the length of the cigarette tube which is to be filled.

When a cigarette of a second shorter length is to be filled, the sizing tab will be moved into the compacting chamber by moving control arm 136 toward the back wall of the machine to the position illustrated in FIG. 7A. When the control arm is in this position, the effective length of the compacting chamber is reduced because tab 122 now extends into the compacting chamber. This reduced length corresponds to the desired shorter cigarette tube length. If in the next cigarette filling operation the user desires to return to a longer tube length, he may simply slide his fingernail behind stub 142 and pull the control arm away from the back of the machine housing, thereby withdrawing tab 122 from the compacting chamber which is now ready to fill the longer tube length.

Figure 8:
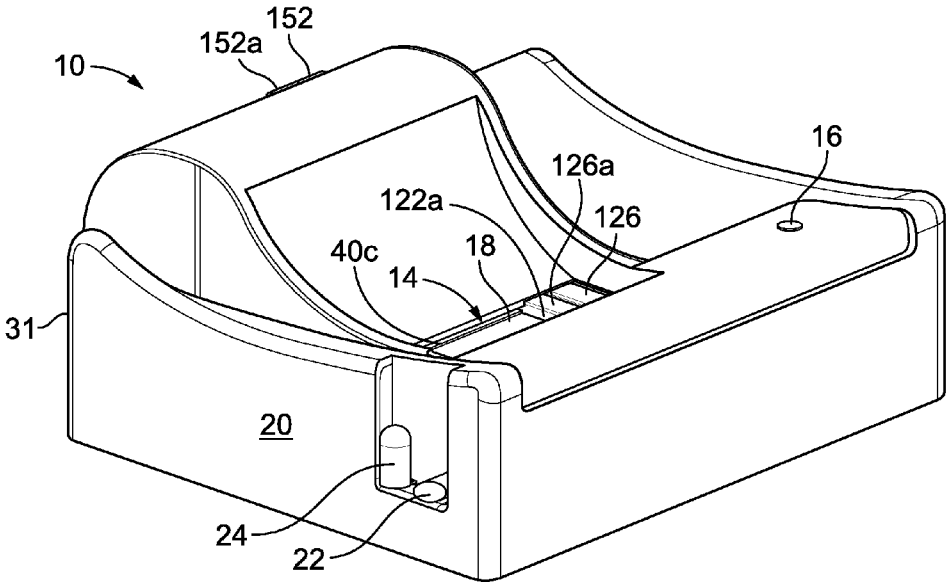
FIG. 8 is a perspective view corresponding to FIG. 2 but including the elongated linkages and tabs of two retractable sizing members.
Figure 9:
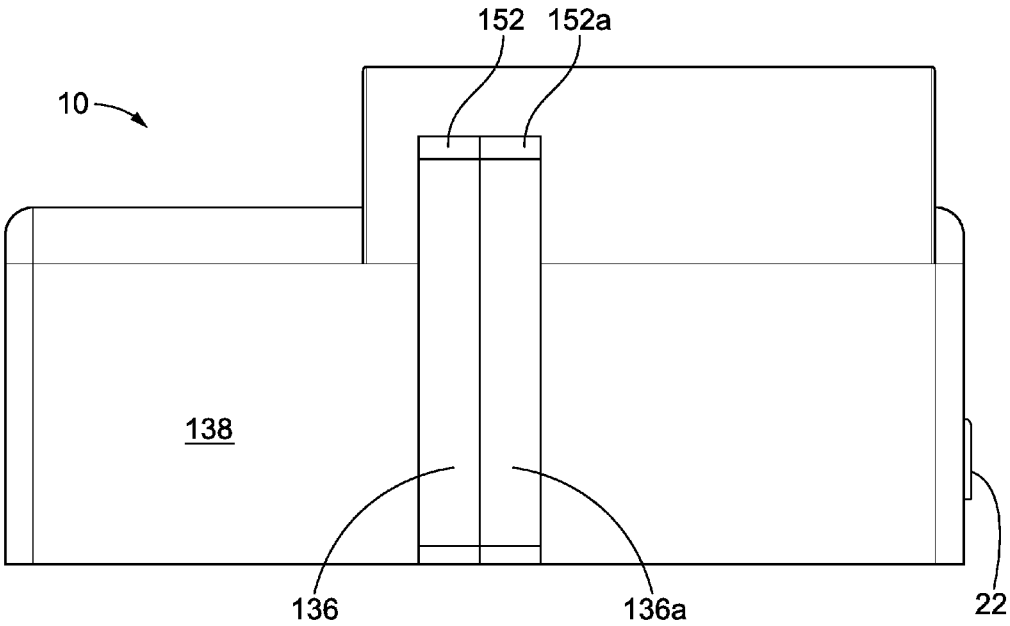
FIG. 9 is a back elevation view corresponding to that of FIG. 6 showing control arms and knobs of two retractable sizing members.
Figure 10A:
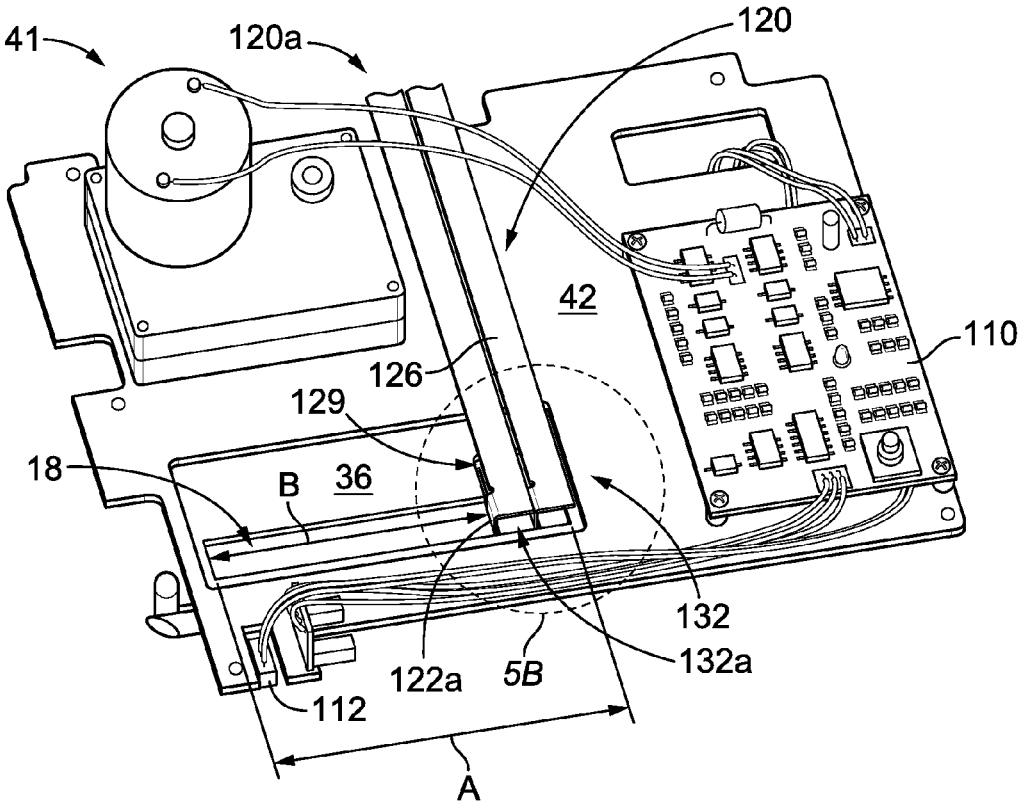
FIGS. 10A and 10B are perspective and enlarged views corresponding to FIGS. 5A and 5B showing details of two retractable sizing members.
Figure 10B:
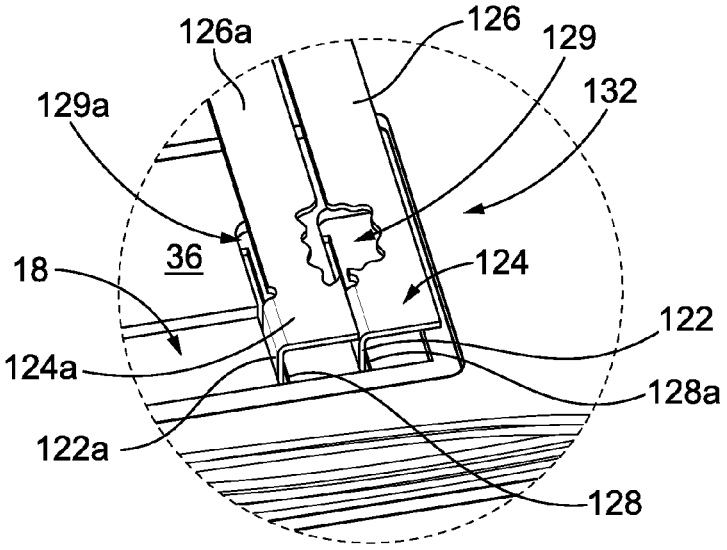

As noted above, two or more retractable sizing members may be employed in embodiments to produce three or more different cigarette lengths by incrementally adjusting (shortening) the effective width of the compacting chamber to correspond to the different cigarette lengths. Thus, FIGS. 8 and 9 show tabs 122 and 122*a* of two retractable sizing members 120 and 120*a* (although more than two similarly structured sizing members may be employed), portions of elongated linkages 126 and 126*a*, control arms 136 and 136*a* and control arm knobs 152 and 152*a*. FIGS. 10A and 10B show two retractable sizing members 120 and 120*a*, sizing member tabs 122 and 122A, sizing member proximal ends 124 and 124*a*, elongated linkages 126 and 126*a*, compacting chamber top wall slots 128 and 128*a*, compacting member tab clearance slots 129/129*a*, and sizing member distal ends 132/132*a*.

In another aspect, a method of using the improved injector-type cigarette-making machine is provided. In this method, loose tobacco is placed in the compacting chamber and a paper cigarette tube of a selected length is disposed on the nipple of the machine. Once the tube and tobacco are in place, the user operates the retractable sizing member described above to set the length of the compacting chamber to a size corresponding to the length of the cigarette tube. Loose tobacco is then placed in the compacting chamber. If a protective door is present, the door is opened before inserting the tobacco. In a fully automatic machine, the machine is then turned on by pressing the appropriate switch or, if a protective door is present, by closing the protective door. In a semi-automatic machine, the machine is manually operated to move the compacting member across the compacting chamber to form a tobacco rod and then a motor is triggered to operate the tobacco spoon for inserting the tobacco rod into the cigarette tube. In a fully manual machine, both the compacting and the inserting steps are manually controlled.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing embodiments (especially in the context of the following claims) are to be construed to cover both the singular and the plural, unless otherwise indicated herein or clearly contradicted by context. It should be understood that the illustrated embodiments are exemplary only, and should not be taken as limiting the scope of the invention. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

LIST OF FEATURES IN FIGURES

| Identifier | Feature |
|---|---|
| 10 | cigarette-making machine |
| 12 | machine top surface |
| 14 | compacting chamber access opening |
| 16 | pushbutton switch |
| 18 | compacting chamber |
| 20 | sidewall |
| 22 | hollow nipple |
| 24 | locking arm |
| 26 | protective system door |
| 28 | bottom edge of door |
| 30 | front of machine |
| 31 | back wall of machine housing |
| 32 | bottom surface of door |
| 34 | compacting chamber bottom plate |
| 36 | compacting member |
| 38 | injection spoon |
| 40a and 40b | Side edges of compacting chamber |
| 40c | top plate of compacting chamber |
| 40d | top edge of compacting chamber |
| 41 | motor |
| 42 | compacting drive mechanism |
| 43 | plate |
| 44 | driveshaft |
| 46 | cam |
| 48 | curved recess in cam |
| 50a, 50b | edges of cam recess |
| 51 | rounded slot end |
| 52 | guide stud |
| 54 | transverse link |
| 56 | dual toggle joint assembly |
| 58A, 58B | lower links of toggle joints |
| 60A, 60B | first lower link ends |
| 62a, 62b | knee pivots |
| 63a, 63b | first upper link ends |
| 64 | top portion of compacting member |
| 65a, 65b | bolt pivots |
| 66a, 66b | upper links |
| 74a, 74b | cam cutout areas |
| 76, 78 | bent stops |
| 80 | injection spoon control arm |
| 82 | link |
| 84 | pin |
| 86 | spring |
| 88 | post |
| 90 | hole |
| 92 | edge of injection arm |
| 94 | projection |
| 100 | horizontal slot |
| 110 | PC board |
| 120/120a | retractable sizing members |
| 122/122a | tabs |
| 124/124a | proximal ends of sizing members |
| 126/126a | elongated linkages |
| 128/128a | slot in top wall of compacting chambers |
| 129/129a | tab clearance slot in compacting member |
| 132/132a | distal ends of sizing members |
| 134 | hinge |
| 136/136a | control arms |
| 138 | machine housing back wall surface |
| 140 | control arm elongated portion |
| 144 | back surface of elongated portion |
| 150 | stub arm |
| 152/152a | control arm knobs |
| 154 | tab slot |
| 154a | top edge of slot 154 |
| 156 | channel in underside of housing |
| 158 | underside of housing |

-continued

| Identifier | Feature |
|---|---|
| 160 | dimple |
| 162 | edge of channel |

What is claimed is:

1. A cigarette tobacco compacting mechanism for making cigarettes in multiple lengths comprising:

a housing;

a compacting chamber located in the housing and accessible from the front of the housing for receiving loose tobacco;

a compacting member mounted for reciprocal motion in the compacting chamber to compact the loose tobacco; and a retractable sizing member with an external control arm accessible from the back of the housing for operating the sizing member, the sizing member having a tab mounted for movement across the compacting chamber, the tab shortening the effective width of the compacting chamber.

2. The cigarette tobacco compacting mechanism of claim 1 in which the compacting member includes a slot opening to the tab to permit the compacting member to reciprocate in the compacting chamber past the tab.

3. The cigarette tobacco compacting mechanism of claim 1 in which the retractable sizing member includes an elongated linkage that is captured against the underside of the housing top surface.

4. The cigarette tobacco compacting mechanism of claim 1 in which the retractable sizing member includes an elongated linkage that is confined laterally in a channel in the back surface of the housing.

5. The cigarette tobacco compacting mechanism of claim 4 in which the channel ends at an edge and the elongated linkage and the elongated linkage includes an upwardly protruding dimple that rides along the surface of the channel and the dimple is positioned to move across the edge to produce a tactile signal when the sizing member is in a predetermined location in the compacting chamber.

6. The cigarette tobacco compacting mechanism of claim 1 including a plurality of retractable sizing members having tabs mounted for movement across the compacting chamber for providing a plurality of effective widths of the compacting chamber.

7. The cigarette tobacco compacting mechanism of claim 1 in which the compacting member is motor-driven.

8. The cigarette tobacco compacting mechanism of claim 1 in which the compacting member is manually controlled.

9. A cigarette-making machine comprising:

a housing including a compacting chamber located in the housing and accessible from the front of the housing for receiving loose tobacco and a compacting member mounted for reciprocal motion in the compacting chamber;

a retractable sizing member with an external control arm accessible from the back of the housing for operating the sizing member, the sizing member having a tab mounted for movement across the compacting chamber, the tab shortening the effective width of the compacting chamber;

an injection spoon for transporting compacted tobacco from the compacting chamber to a cigarette tube;

a compacting drive mechanism for operating the reciprocating compacting member; and an injection drive mechanism for operating the injection spoon.

10. The cigarette-making machine of claim 9 in which the compacting member includes a slot opening to the tab to permit the compacting member to reciprocate in the compacting chamber past the tab.

11. The cigarette-making machine of claim 9 in which the retractable sizing member includes an elongated linkage that is captured against the underside of the housing top surface.

12. The cigarette-making machine of claim 9 in which the retractable sizing member includes an elongated linkage that is confined laterally in a channel in the back surface of the housing.

13. The cigarette-making machine of claim 12 in which the channel has an edge and the elongated linkage includes an upwardly protruding dimple that rides along the surface of the channel and the dimple is positioned to move across the edge to produce a tactile signal when the sizing member is in a predetermined location in the compacting chamber.

14. The cigarette-making machine of claim 9 including a plurality of retractable sizing members having tabs mounted for movement across the compacting chamber for providing a plurality of effective widths of the compacting chamber.

* * * * *